United States Patent [19]

Wassilieff

[11] Patent Number: 4,624,377

[45] Date of Patent: Nov. 25, 1986

[54] CHILD RESISTANT CLOSURE

[75] Inventor: Victor Wassilieff, Paris, France

[73] Assignee: Zeller Plastik, Koehn, Grabner & Co., Zell/Mosel, Fed. Rep. of Germany

[21] Appl. No.: 797,762

[22] Filed: Nov. 13, 1985

Related U.S. Application Data

[62] Division of Ser. No. 604,138, Apr. 26, 1984, abandoned.

[30] Foreign Application Priority Data

Apr. 29, 1983 [DE] Fed. Rep. of Germany ..... 3315548

[51] Int. Cl.[4] ..... B65D 55/02

[52] U.S. Cl. ..... 215/220

[58] Field of Search ..... 215/219, 220

[56] References Cited

FOREIGN PATENT DOCUMENTS 570312 12/1975 Switzerland ..... 215/219

*Primary Examiner*—George T. Hall

*Attorney, Agent, or Firm*—Kane, Dalsimer, Kane, Sullivan and Kurucz

[57] ABSTRACT

A child resistant closure for bottles is provided that permit closure withdrawal by exerting an axial force and a simultaneous rotating movement. For this purpose, a clutch is provided between an inner cap and an outer cap of the closure with at least one elastic flexible clutch element which is ineffective in its rest position and which is deformable upon application of an axial downward force. In this manner, a sufficient friction lock is generated between the two caps, so that the outer cap takes along the inner cap during screwing on and unscrewing off. In the absence of the axial force the outer cap will slide over and not turn the inner cap.

6 Claims, 13 Drawing Figures

CHILD RESISTANT CLOSURE

This is a divisional of co-pending application Ser. No. 604,138 filed on Apr. 26, 1984 now abandoned.

BACKGROUND OF THE INVENTION

The invention relates to a child resistant closure for containers, in particular, bottles and which is suitable for application with capping equipment.

A child resistant closure has been proposed in DE-PS No. 25 50 538, which is provided with a clutch having projections which cause interengagement of an inner cap and the outer cap during screwing on of the cap. However, during unscrewing, an axial force has to be exerted on the outer cap in the direction of the orifice, so that the projections mounted on one cap take along the projections of the other cap. Otherwise, the projections slide without unscrewing the inner cap.

Normally closures are to be screwed onto the orifices of bottles by means of automatic capping machines. The maximum torque to be exerted by the capping machine must be adjusted to a narrow tolerance, so that the bottle orifices are tightly closed, on the one hand, but that it is not closed too tightly because the inner cap would be too hard to release even by adults or perhaps be destroyed during the screwing on process.

In known child resistant closures, a child-resistant position is obtained only when the inner cap has been screwed onto the orifice with a sufficiently large torque. However, if the cap was screwed on lightly or only partially along its rotating path, it can be unscrewed without exerting an axial force in the direction of the orifice, since the clutch elements will transmit sufficient torque.

SUMMARY OF THE INVENTION

In accordance with the invention, a closure is provided wherein a rotating moment together with a simultaneous axial force directed toward the orifice is required to be exerted for opening the closure independent of the manner with which the inner cap was screwed on. It is also irrelevant how large the maximum torque of a capping machine had been set or how much of a torque moment was applied on the closure by a consumer.

These and other objects are attained by a closure which during axial movement causes deformation of a clutch element which in its rest position is not actuated, so that the outer cap can freely rotate on the inner cap. Thus, a resistant feature and effect is obtained so that the closure is child resistant. The child resistant characteristic of the closure is still assured should the inner cap be closed only partially or very loosely. During screwing on as well as during unscrewing, the outer cap must be moved axially toward the orifice. Only then is the clutch element sufficiently deformed, so that it takes along the inner cap by means of interlocking friction. The friction lock can be so dimensioned that the maximum transmitted torque moment can be controlled and is sufficient for closing the inner cap, on the one hand, but is not sufficient to cause an increase in torque to large for adults or to destroy the closure if, for example, a capping machine is set in such a manner that it would transmit too high a torque moment. If too large a torque moment is transmitted to the outer cap, sliding movement occurs between the outer cap and the clutch element after the friction torque moment is overcome.

Therefore, the closure in accordance with the invention does not transmit any torque moment in its rest position nor when the outer cap is completely depressed beyond specified maximum amount which solely depends from the shape and the elastic spring force of the clutch element.

In accordance with another embodiment of the invention, the clutch element may be shaped in the form of a flexible membrane which is connected with the one cap and has a segment which is positioned in close proximity adjacent to the other cap in the rest position without causing friction locking. When performing the axial movement one segment of the membrane, which previously was straight or slightly curved when looking at its longitudinal section, is now curved or more heavily curved. Consequently the membrane exerts a radial force, so that the desired friction lock is generated which is required for taking along the inner cap.

In accordance with another embodiment of the invention, both caps are locked with each other in a simple manner so that the outer cap cannot become disattached and be lost.

The elastic membrane may be a component of one of the caps or may be a separate structural element which is slipped over one of the caps, and, in particular, the inner cap. A separate membrane permits the closure to have a low axial height. In addition, this permits wider material selection for the membrane and the caps.

A trough like segment of a membrane which may be a component of one of the caps, connects the skirt and the cover plate of the cap and extends into an annular chamber of the other cap. When exerting axial pressure the membrane clamps within this annular chamber and generates the friction lock.

One of the clutch elements may have the shape of a hollow frustum. When depressing the outer cap this wall is deformed in such a manner that the cone opening increases. The open end of the wall presses against a second clutch element in the form of an annular-like projection, either to the inside or the outside depending on the type of construction. Both clutch elements clamp each other mutually, so that the desired friction lock is generated. The skirt of the outer cap may act as the annular-like projection.

At least one pair of walls in form of hollow frustums may be provided which are positioned on the cover plates of both caps and which interlock without any friction in their rest position. The walls have different conical openings and engage with each other when exerting axial pressure thereon due to the elastic deformation. The force generated by the elastic deformation provides the required friction lock. In accordance with this further embodiment, closures with a reduced diameter are possible.

Two pairs of such conical walls may be concentrically positioned with respect to each other. In such event, a reduced diameter closure is obtained as well as one of reduced structural height. The skirts of both caps may be shaped in the form of hollow frustums, thereby enabling simple injection molds to be used for making the caps.

BRIEF DESCRIPTION OF THE DRAWINGS

Exemplified embodiments of the invention will be described in the following in conjunction with the drawings in which.

All figures are axial sectional views through the inner cap, outer cap and the clutch elements; and all figures show the rest position at the left side at which the outer cap and the inner cap are freely rotatable, while the right side shows the contemplated camming action which is obtained by depressing the outer cap with respect to the inner cap to thereby generate friction locking by the clutch elements.

DETAILED DESCRIPTION

Figure 1:
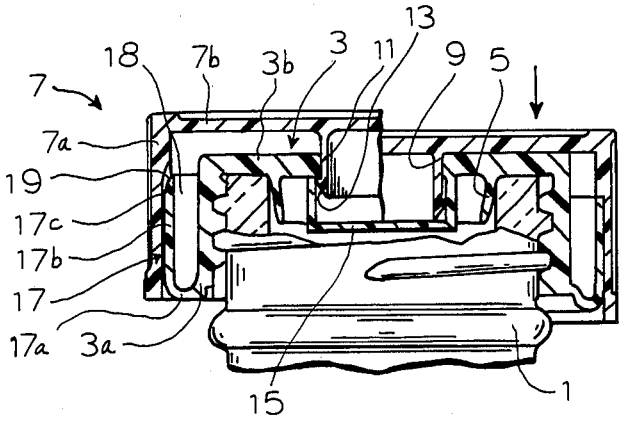
FIGS. 1 to 7 show embodiments having one flexible membrane with a trough like segment.

Referring initially to FIG. 1, the mouth or orifice 1 of a bottle is shown having outer threads. An inner cap 3 with inner threads of a closure in accordance with the invention is screwed on the outer bottle threads. The inner cap 3 has a skirt 3*a* and a cover plate 3*b*. A downwardly extending annular seal 5 is provided on the cover plate. An outer cap 7 with a skirt 7*a* and a cover plate 7*b* is disposed over the inner cap 3. The outer cap has a hollow cylindrical wall 11 which extends through a central opening 9 of the inner cap. The wall 11 has an outwardly extending flange 13 on its lower edge which snaps outwardly and is anchored with the inner cap. The opening 9 of the inner cap is sealed by a wall 15.

An elastic flexible membrane 17 which is inverted upwardly engages the lower edge of inner cap 3. It has a trough-like segment 17*a* and adjacent thereto a cylindrical segment 17*b* which in its rest position is a small distance from the inner wall of the outer cap 7. The free edge 17*c* of the membrane supports on an inner shoulder 19 of outer cap 7. At this juncture, slight movement is provided so that negligible torque moment is transmitted from the outer cap to the membrane and thereby to the inner cap.

When the outer cap 7 is depressed in the direction of the arrow, the two cover plates will eventually abut one another and the inner shoulder 19 presses against the free edge 17*c* and the cylindrical segment 17*b* of the membrane. Consequently, the lower part of the cylindrical segment 17*b* is forced to curve or bow outwardly, against the tending to restore it to its original shape thereby pushing radially outwardly against the inner wall of outer cap 7. This generates the desired friction interlock between the caps. The membrane is so dimensioned and is made from such material that a torque moment is generated by means of the friction interlocking which is sufficient to securely screw the inner cap closed for sealing and also to release the inner cap again when desired. When using conventional capping machines this structural arrangement limits torque moment of the screwing operation. When the inner cap is completely screwed tight and if a further torque moment of increased magnitude is exerted on the outer cap, the outer cap will eventually rotate around the membrane. Accordingly, this prevents creating to large an unscrewing torque or breaking of the closure should too large a torque moment be generated.

Figure 2:
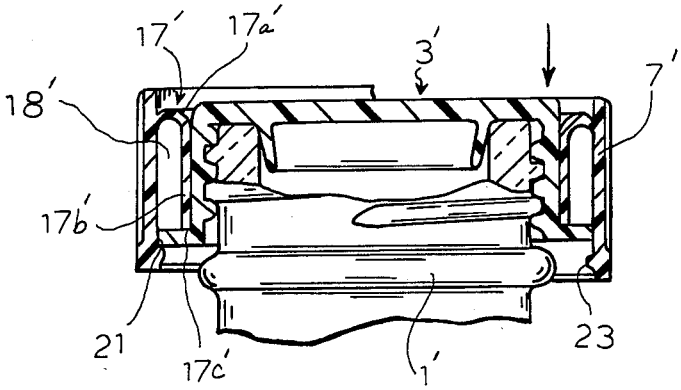

In FIG. 2 a similar type of structure is shown with the membrane 17' mounted on the outer cap 7' which is shaped substantially in the form of a cylindrical ring. The free edge 17*c'* of the membrane 17' is supported on an outer flange 21 of the inner cap 3'. Both caps are retained with each other which coacts with outer flange 21.

Figure 3:
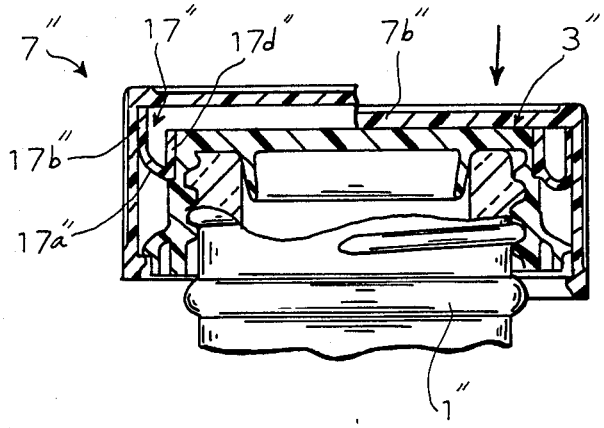

In accordance with the embodiment of FIG. 3, a separate membrane 17*a''* is provided which permits a wider variety of materials to be used. The membrane 17*b''* has an inner cylindrical segment 17*d* which snugly embraces a smaller diameter segment of the inner cap 3''. The membrane is inverted upwardly and has a trough-like segment 17*a* with segment 17*b''* in juxtaposition with the cover plate 7*b''* of the outer cap 7''. This embodiment corresponds in friction with the embodiment in accordance with FIG. 1.

Figure 4:
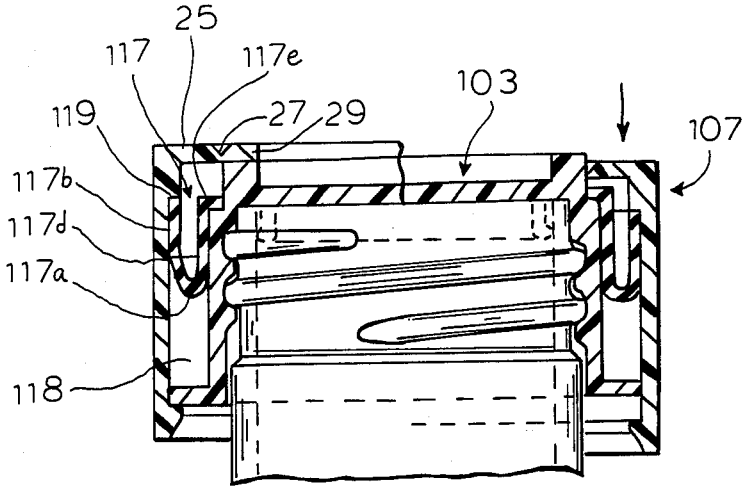
Figure 5:
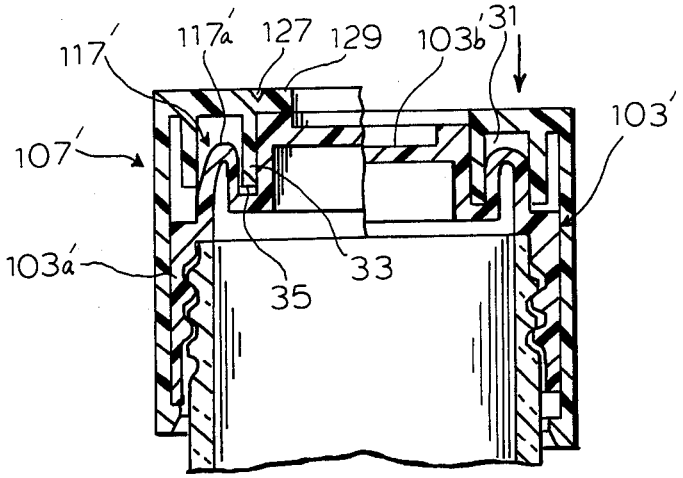

The embodiments in accordance with FIGS. 4 and 5 demonstrate that closures in accordance with the invention may have combined chld resistant and tamper evident features. The embodiment in accordance with FIG. 4 has an insertable, elastic flexible membrane 117, with an inner flange 117*e* and a cylindrical segment 117*d* which can be slipped over the inner cap 103. The membrane has a trough-like segment 117*a* and a cylindrical segment 117*b* which in the rest position of the inner wall is in close proximity and adjacent to a substantially cylindrical outer cap 107, but without any frictional interlock. As in FIG. 1 the upper edge of the membrane abuts against an inner should 119 of outer cap 107. The outer cap has an inwardly extending flange 25 which includes an annular reduced annular zone 27 in an inner annular resistant ring 29. Bearing in mind, no friction interlock initially exists (FIG. 4 left), but during first time use the outer cap 107 is pushed downwardly in the direction of the arrow, in such a manner that the resistant ring 29 breaks off at reduced annular zone 27 thus producing evidence of first opening. The operation of this embodiment will then correspond with that of previous embodiments.

In accordance with the embodiment of FIG. 5, a resistant ring 129 is again provided which is severed when the reduced annular zone is forced to rupture during first time use. The membrane 117 is an integral component of inner cap 103 and connects the cylindrical segment 103*a* with the inner thread and the associated cover plate 103*b*. The trough-like segment 117*a* of the membrane extends into an annular chamber 31 of the outer cap 107'. A short cylindrical shoulder 33 of the outer cap extends downwardly into a small annular chamber 35 of the inner cap and is disposed at the bottom thereof. When depressing the outer cap, the resistant ring 29 is at first severed along the reduced annular zone 127.

Thereafter, the membrane is forced downwardly to a position shown at the right side of FIG. 5, whereby it expands and exerts radial forces inwardly as well as outwardly against the walls of annular chamber 31 of the outer cap. In this manner, the desired friction interlock is generated.

Figure 6:
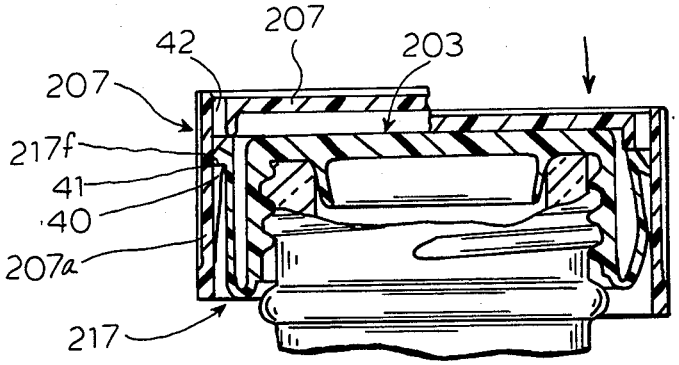

In accordance with the embodiment of FIG. 6 a membrane 217 is provided which in many respects is similar to the membrane of FIG. 1. However, at its free edge it is provided with a slightly downwardly depending annular flange 217*f*. The inner wall of the skirt of the outer cap 207 is provided with a plurality of parallel radially inwardly directed ribs 40. These ribs have a width of about 2 mm in a circumferential direction and are separated by intermediary spaces of about the same width. The ribs 40 extend vertically at their top and having a slightly upwardly and inwardly obliquely directed abutment face 41. After introducing the inner cap 203 into the outer cap 207 the flange 217*f* hooks over the top face 41 of ribs 40 and secures the outer cap 207 in a non-releasable manner, on the inner cap 203.

The cover plate 207*b* is connected with skirt 207*a* by means of spaced radial lugs or crosspieces 42', and, there are many crosspieces as are ribs 40.

Figure 7:
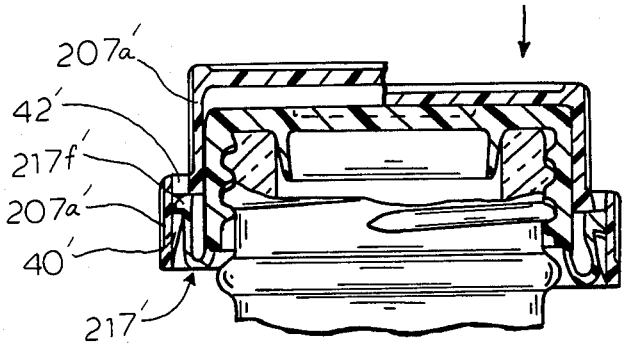

FIG. 7 shows a similar embodiment wherein the membrane 217' is somewhat shorter in height, and, accordingly, the ribs 40' are also shorter. Here the crosspieces 42' connect the skirt sections 207*a''* and 207*a''* which are of a different diameter.

The following embodiments to be described do not have a membrane with a trough-like segment, but have in common as a clutch part, at least one wall frustoconical shape.

Figure 8:
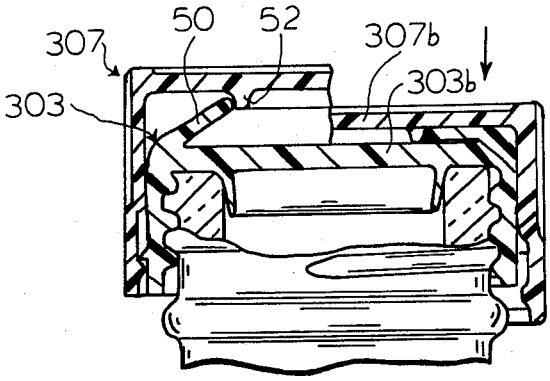
FIGS. 8 and 9 show embodiments wherein the clutch is also provided with a wall in the form of a hollow frustum.

Accordingly, FIG. 8 shows a conical wall 50 which engages on the outer edge of the cover plate 303*b* of the inner cap 303 and which is directed inwardly at an angle of about 30° to 40°. An annular projection 52 is provided on the inner wall of cover plate 307*b* of the outer cap which forms an abutment for the free inner upper edge of wall 50. In the rest position (left in FIG. 8) projection 52 and wall 50 are slightly spaced from one another. However, axial force is applied to the outer cap 307, wall 50 tilts and bends inwardly and toward cover plate 303. In so doing wall 50 pushes against the projection 52 with increasing friction force to cause an interlock.

Figure 9:
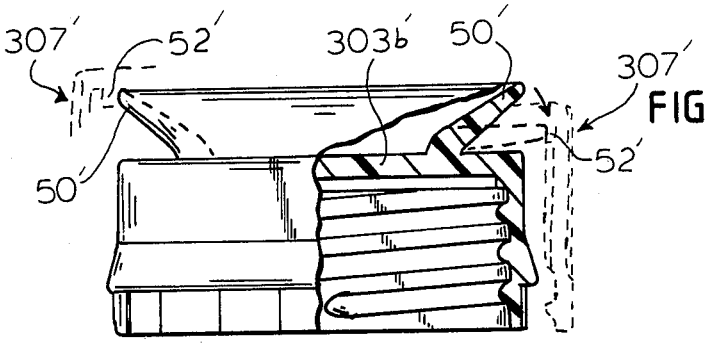

FIG. 9 shows that the wall 50' may alternatively be directed outwardly rather than inwardly. The desired camming action is obtained by having this wall 50' bend outwardly and engage surfaces of an annular projection 52' and the inner wall of the outer skirt 307*a'*.

Figure 10:
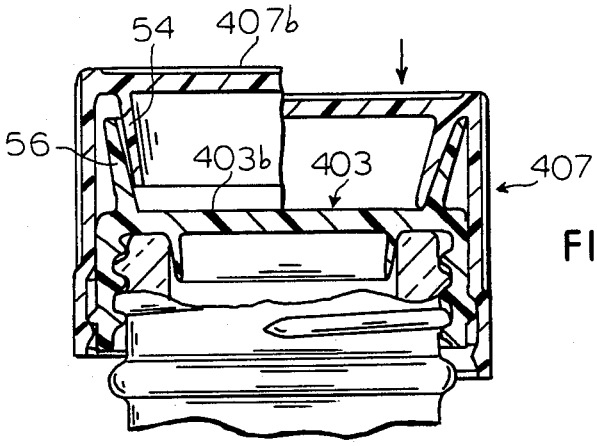

In accordance with FIG. 10 two frusto conical walls 54 and 56 are provided. Wall 54 extends downwardly and somewhat inwardly from the cover plate 407*b* of the outer cap 407. Wall 56 extends upwardly and somewhat outwardly from the cover plate 403*b* of the inner cap 403. The angle of inclination of the conical walls different by about 10° to 20°, so that the lower edge of the wall 54 is proximal to wall 56 when it is in the rest position but without exerting a friction interlock. When the outer cap 407 is depressed, walls 54 and 56 engage snugly and cam against each other under the influence of the axial force. The elastic forces which are generated by the deformation of the conical walls generate the desired friction interlock.

Figure 11:
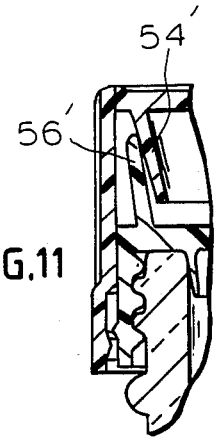
FIGS. 10 to 12 show embodiments with parts of walls in the form of hollow frustums which act as clutch elements.

FIG. 11 shows that the conical wall arrangement can be in the reverse, in that the upper free edge of wall 56' is in close proximity to wall 54'. Otherwise the function of the closure is the same as in FIG. 10.

Figure 12:
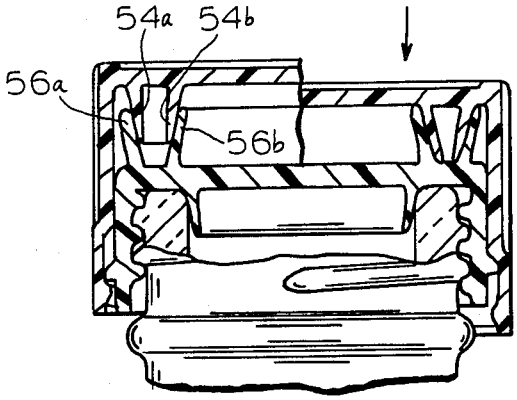

FIG. 12 shows that one can provide two pairs of such oblique walls, namely, convergent walls 54*a* and 54*b* on the outer cap and divergent walls 56*a* and 56*b* on the inner cap in order to obtain the desired action, the walls of both pairs will engage with each other by means of the elastic deformation when the outer cap is depressed. The required friction force is thereby generated on two radially separated locations. Therefore, a closure of reduced construction is possible for this embodiment.

Figure 13:
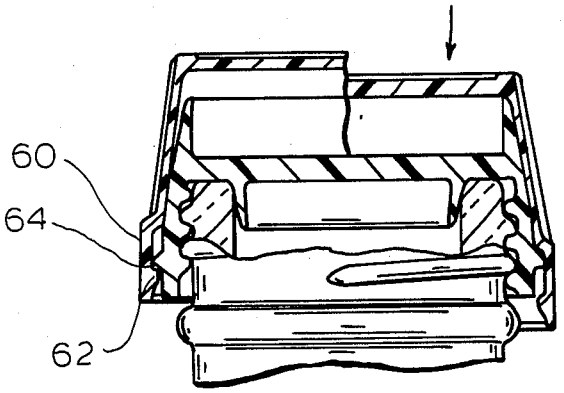
FIG. 13 shows an embodiment wherein the cap skirts themselves form such walls.

FIG. 13 shows that the skirts of the outer and inner caps themselves may be shaped in the form of hollow frustums. The surfaces of the skirt of the caps will cam against one another when the outer cap is depressed. In order to retain the outer cap on the inner cap a ring 60 is provided on the lower edge of the outer cap which after being slipped on the inner cap permits its inwardly extending flange 62 to override and lock behind outwardly extending flange elevation 64 of the inner cap.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A child resistant closure for a container having a neck opening that may be withdrawn from the container by applying an axial force and a simultaneous rotational movement comprising in combination:

a. an inner cap adapted to fit the orifice and couple with the container neck, the inner cap having a circumferentially extending skirt and an inner cover plate;

b. an outer cap extending around the skirt of the inner cap and having an outer cover plate;

c. a clutch effective between said two caps, whereby said clutch engages by means of an axial movement directed against the outer cap by exerting an axial force thereon, so that a rotational torque exerted on the outer cap is transferable to the inner cap;

d. the clutch being provided with two axial symmetrical clutch elements, at least one element being an elastically deformable clutch element and being ineffective in its rest position and deformable during axial movement of the outer cap in such a way that a sufficient friction interlock is generated between said two caps, said one of the clutch elements comprising a wall in the form of a hollow frustum having an open end connected with one of the cover plates in such a manner that the other open end of said wall is directed toward the other cover plate and the other cap having annular shaped projections proximal to the open end of the wall in the rest position and is adapted to engage therewith to cause the friction interlock.

2. A closure in accordance with claim 1, wherein the skirt of the outer cap is the annular projection.

3. The closure of claim 1 wherein said one clutch element is connected to the inner cover plate.

4. The closure of claim 1 wherein said one clutch element is disposed at an angle in a range of 40°–50° with respect to a longitudinal axis of the closure.

5. The closure of claim 1 wherein said other element comprises an annular wall disposed radially inward with respect to said one element.

6. A child resistant closure for a container having a threaded neck that may be withdrawn from the container by applying an axial force and a simultaneous rotational movement comprising:

an inner cap having an inner skirt with an inner threaded surface for engaging said threaded neck, and an inner cover over said skirt;

an outer cap disposed around said inner cap and having an outer skirt disposed radially outwardly of said inner skirt and an outer cover extending over said outer skirt and axially spaced from said inner cover; and coupling means disposed between said inner and outer covers and including a first member shaped in the form of an open frustum, said first member being elastically deformable and being secured to one of said covers and extending toward the other cover, and a second member comprising an annular wall disposed on the other cover;

said first cap having a rest position wherein said first cap is fully rotatable with respect to said second cap, said first and second member being constructed and arranged to form a friction interlock when said first cap is urged axially from said rest position toward said inner cap by the engagement between said frustum and said wall.

* * * * *